US005272408A

United States Patent [19]

Levin et al.

[11] Patent Number: 5,272,408

[45] Date of Patent: Dec. 21, 1993

[54] LAMP AND REFLECTOR ASSEMBLY

[75] Inventors: Robert E. Levin, South Hamilton, Mass.; Lieven A. DeWeerdt, Edegem, Belgium

[73] Assignee: GTE Products Corporation, Danvers, Mass.

[21] Appl. No.: 697,828

[22] Filed: May 9, 1991

[51] Int. Cl.[5] ..... F21V 7/00

[52] U.S. Cl. ..... 313/113; 313/114; 313/116; 362/296; 362/297

[58] Field of Search ..... 313/113, 114, 116, 569, 313/578, 579; 362/296, 297, 304, 305

[56] References Cited

U.S. PATENT DOCUMENTS

| | | | |
|---|---|---|---|
| D. 61,209 | 7/1922 | Otte . | |
| D. 61,210 | 7/1922 | Otte . | |
| D. 253,195 | 10/1979 | Henkel et al. | D48/20 E |
| 153,341 | 7/1874 | Jacobson . | |
| 1,347,268 | 7/1920 | Godley . | |
| 1,394,319 | 10/1921 | McNeal . | |
| 2,751,816 | 6/1956 | Strong | 88/73 |
| 3,511,983 | 5/1970 | Dorman | 240/41.15 |
| 3,768,900 | 10/1973 | McLintic | 353/98 |
| 4,021,549 | 5/1977 | Wiley | 240/41.36 |
| 4,041,344 | 8/1977 | LaGuisa | 313/113 |
| 4,153,929 | 5/1979 | Laudenschlarger et al. | 362/348 |
| 4,545,000 | 10/1985 | Fraley et al. | 362/304 |
| 4,608,512 | 8/1986 | Rakitsch | 313/113 |
| 4,686,412 | 8/1987 | Johnson, Jr. | 313/113 |
| 4,755,711 | 7/1988 | Fields et al. | 313/113 |
| 4,829,210 | 5/1989 | Benson et al. | 313/113 |
| 4,833,576 | 5/1989 | Mers et al. | 362/226 |
| 4,918,353 | 4/1990 | Nelson et al. | 313/113 |

FOREIGN PATENT DOCUMENTS

| | | |
|---|---|---|
| 0271857 | 6/1988 | European Pat. Off. . |
| 2082745 | 10/1982 | United Kingdom . |

OTHER PUBLICATIONS

R. Hopkins, "Mirror and Prism Systems"; Applied Optics and Optical Engineering, vol. III; Academic Press, 1965, pp. 269 to 308.

*Primary Examiner*—Donald J. Yusko
*Assistant Examiner*—N. D. Patel
*Attorney, Agent, or Firm*—Wolf, Greenfield & Sacks

[57] ABSTRACT

A lamp assembly includes a reflector having a concave reflecting surface and an axis of rotation, and a light source including a filament mounted at or near a focal point of the reflecting surface. The filament has a length to diameter ratio of 6:1 or greater. The reflecting surface is formed as a multiplicity of reflecting facets. The facets on at least 50% of the reflecting surface have dimensions and curvatures selected to produce a light pattern wherein a ratio of filament width spread to filament length spread produced by the facets is at least 2:1. Preferably, the facets are arranged in axially adjacent rings. The facet rings can be successively offset in a rotational direction so as to reduce circumferential variations in the light pattern.

13 Claims, 8 Drawing Sheets

LAMP AND REFLECTOR ASSEMBLY

FIELD OF THE INVENTION

This invention relates to electric lamps having reflectors for providing a desired light pattern and, more particularly, to a lamp assembly including a reflector having a multiplicity of reflecting facets and a relatively long, small diameter filament.

BACKGROUND OF THE INVENTION

Reflector lamps, commonly known PAR lamps, are well known in the art and have been in commercial use for many years. These lamps are fabricated of pressed glass and include a reflector having a reflecting surface, a light source and a cover or lens. The reflecting surface is typically a concave paraboloid. Although the light source is typically a tungsten filament or a tungsten halogen lamp capsule, an arc discharge tube also can be utilized. The cover may be clear or may be omitted when a tungsten halogen capsule is used, but most commercial lamps have had stippled and/or lenticular configurations in the cover glass to smooth the beam and/or to provide the required beam spread. The filament is located as close as possible to the focal point of the reflecting surface.

A principal advantage of PAR lamps is that the reflector and the lens form optically controlled light beams ranging from narrow spotlights to wide floodlights. Beam angles range from a few degrees to about 60 degrees. Since the lamps are prefocused at the time manufacture, the problems of combining separate components in the field are avoided. Since the optical surfaces are sealed within the lamp, they remain clean and in good condition throughout the life of the lamp, regardless of environmental conditions. Luminaires and lampholders do not require any optical components and are relatively inexpensive and simple to manufacture. Nevertheless, different beam spreads and beam intensities are possible with a single luminaire simply by selecting another PAR lamp.

One of the problems in designing PAR lamps is to control the beam pattern produced by the lamp for different sizes and orientations of filaments. Although the filament is typically located at or near the focal point of the reflector, beam spreading occurs because the filament has a finite size. The dimensions of the filament are dictated primarily by the voltage and wattage ratings of the lamp. It has been particularly difficult to obtain a desired light pattern with a long, small diameter filament, which generally corresponds to a relatively high operating voltage. The beam pattern produced by a long, small diameter filament mounted axially in a reflector typically includes a small central area of high intensity and a large surrounding area of lower but significant intensity. The desired pattern is a central region of uniformly high intensity which smoothly falls off to an insignificant value outside the central region.

Prior attempts to overcome the above problem have included the use of shorter, lower voltage filaments and mounting the filament transversely with respect to the reflector axis. Another technique for controlling the beam pattern from a reflector lamp involves spreading and smoothing the light by roughening the reflecting surface microscopically and/or macroscopically. This technique provides little control over where the light is scattered.

Still another technique for controlling the light pattern is to introduce small local deformations of the basic reflector surface. The local deformations can take the form of facets, peens, ribs, or the like. In this case, the light is spread by a specular surface through a given angular range that is established by the geometry of the local curvature. The advantage of facets or peens is that the light is spread about the direction that the light would take in the absence of the element, and the magnitude of the spread is determined by the design of the element. No light is spread beyond the design limit. Thus, control of the beam shape is maintained, and light is not scattered out of the beam to reduce beam efficiency unless such spread is deliberately desired.

A projector lamp reflector having a faceted surface for spreading the image formed by the reflector into a larger and smoother pattern and reducing the amount of imaging of the lamp filament and support posts is disclosed in Wiley U.S. Pat. No. 4,021,659 issued May 3, 1977.

A headlight reflector having offset facets is disclosed in McNeal U.S. Pat. No. 1,394,319 issued Oct. 19, 1921. The facet rings in the McNeal reflector appear to have different numbers of facets.

A projection lamp with a reflector having facets and an axially oriented filament is disclosed in Fraley et al. U.S. Pat. No., 4,545,000 issued Oct. 1, 1985.

Multifaceted reflectors are also disclosed in Laudenschlarger et al U.S. Pat. No. 4,153,929 issued May 8, 1979; Dorman U.S. Pat. No. 3,511,983 issued May 12, 1970; Henkel et al U.S. Pat. No. D. 253,195 issued Oct. 16, 1979; Otte U.S Pat. No. D. 61,209 issued Jul. 11, 1922; and Otte U.S. Pat. No. D. 61,210 issued Jul. 11, 1922. None of the prior art reflectors known to applicants has been entirely satisfactory in producing a desirable light pattern when a long, small diameter filament is utilized.

It is a general object of the present invention to provide improved reflector lamp assemblies.

It is another object of the present invention to provide a faceted lamp reflector for use with a long, small diameter filament.

It is yet another object of the present invention to provide reflector lamp assemblies that are operable with relatively high voltages.

It is still another object of the present invention to provide reflector lamp assemblies that have a selectable beam width without a surrounding area of low but significant intensity.

It is still another object of the present invention to provide reflector lamp assemblies having uniform beam patterns.

It is a further object of the present invention to provide reflector lamp assemblies wherein circumferential variations in the beam pattern are substantially eliminated.

It is a further object of the present invention to provide reflector lamp assemblies that are easy to manufacture and low in cost.

It is yet a further object of the present invention to provide a technique wherein significantly differing beam angles can be formed without changing the size or basic shape of a projector lamp reflector.

SUMMARY OF THE INVENTION

According to the present invention, these and other objects and advantages are achieved in a lamp assembly comprising a reflector having a concave reflecting surface and an axis of rotation, and a light source including a filament mounted at or near a focal point of the reflecting surface and aligned with the axis of rotation, the filament having a length to diameter ratio of 6:1 or greater, the reflecting surface comprising a multiplicity of reflecting facets, the facets on at least 50% of the reflecting surface having dimensions and curvatures selected to produce a light pattern wherein a ratio of filament width spread to filament length spread produced by the facets is at least 2:1.

The axis of rotation defines an axial direction and a rotational direction around the axis. Preferably, the reflecting facets are arranged in axially adjacent rings that are centered on the axis and lie in a plane perpendicular to the axis. Typically, at least a plurality of the facet rings each has the same number of facets.

In a preferred embodiment, adjacent rings with the same number of facets are successively offset in the rotational direction so as to reduce circumferential variations in the light pattern. The total rotational offset of the plurality of rings is preferably not less than about one half the angle subtended by one of the facets.

The facets have a curvature and dimension in the rotational direction selected to provide the desired filament width spread. The facets are typically rectangular in shape and are not substantially curved in the axial direction so as to limit filament length spread.

According to another aspect of the invention, there is provided a lamp assembly comprising a reflector having a concave reflecting surface and an axis of rotation that defines an axial direction and a rotational direction around the axis, and a light source including a filament mounted at or near a focal point of the reflecting surface and aligned with the axis of rotation, the reflecting surface comprising a multiplicity of reflecting facets arranged in axially adjacent rings that are centered on the axis and lie in a plane perpendicular to the axis, at least a plurality of the rings having the same number of facets, adjacent rings with the same number of facets being successively offset in the rotational direction.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
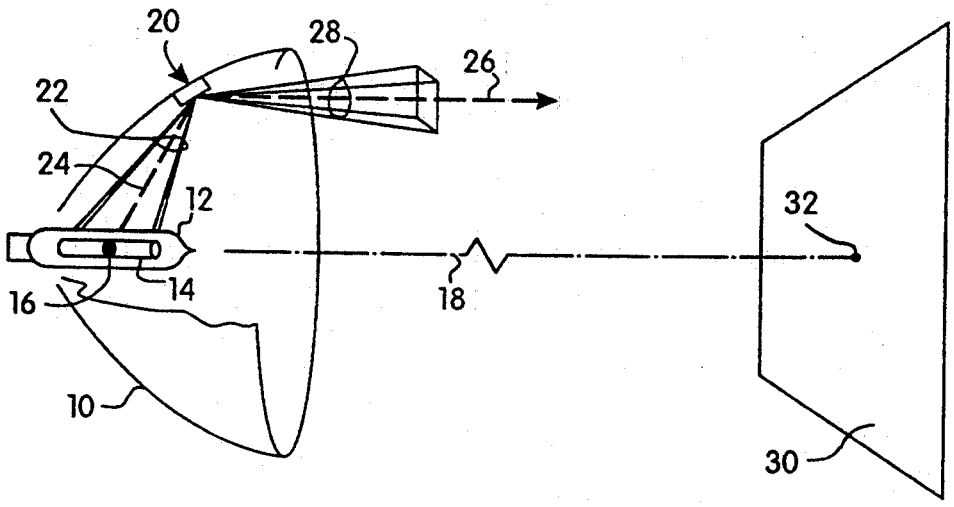
FIG. 1 is a schematic diagram of a reflector lamp assembly showing the reflection produced by an incremental area of the reflecting surface.

As discussed above, it has been difficult to obtain a desired light pattern in a reflector lamp having a long, small diameter filament. A reflector lamp having a long, small diameter filament is shown in FIG. 1. A reflector 10 of approximately paraboloidal shape contains a high voltage tungsten halogen capsule 12 with a long, small diameter tungsten incandescent filament 14. As used herein, long, small diameter filaments include those having a length to diameter ratio of at least 6:1. The filament 14 is approximately centered on a focal point 16 of reflector 10. The longitudinal axis of filament 14 lies on an axis 18 of reflector 10. A small, incremental element 20 of the reflector surface is located at an arbitrary point on the reflecting surface and has a normal that intersects or passes near the reflector axis 18. Light from the filament 14 arrives at element 20 within the bounds of a solid angle 22 that is in the form of a pyramidal cone. A light ray 24 that appears to leave the focal point and strike element 20 is reflected as a light ray 26 essentially parallel to the axis 18 of the reflector. If the element 20 is sufficiently small, it acts similar to a small plane mirror that reflects all rays within the incident solid angle 22 into another geometrically similar solid angle 28 about the ray 26.

Figure 2:
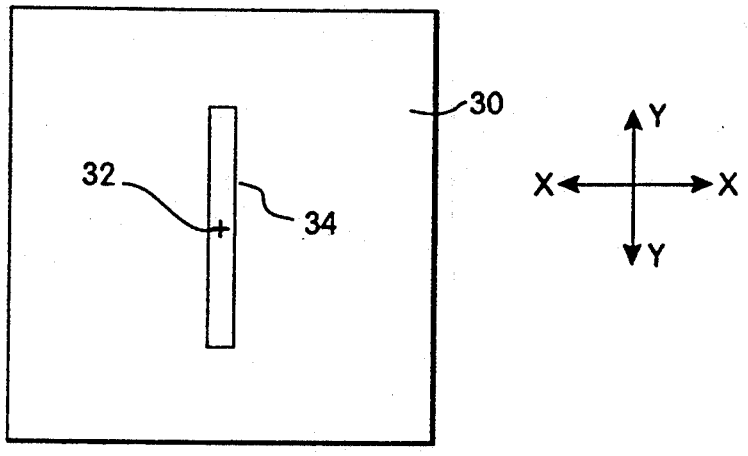
FIG. 2 shows an image of a long, small diameter filament produced by the incremental area of the reflecting surface shown in FIG. 1.

A screen 30 is positioned perpendicular to reflector axis 18 and at a great distance from the reflector 10. The axis 18 intersects the screen at point 32. The screen 30, viewed along axis 18 from the position of reflector 10, is shown in FIG. 2. The light within the reflected solid angle 28 strikes the screen within a boundary 34 as an image of filament 14. The size, aspect ratio and orientation of boundary 34 depends not only on the filament dimensions, but also on the location of element 20 in space relative to filament 14.

Figure 3:
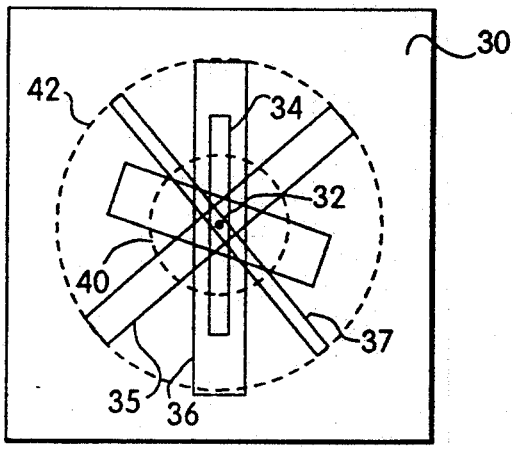
FIG. 3 shows images of a long, small diameter filament produced by several incremental areas of the reflecting surface shown in FIG. 1.

The screen 30 is shown in FIG. 3 with light reflected from incremental elements at several different locations on the reflector 10 to form images 35, 36, 37, etc. In general, the light pattern produced on screen 30 by the reflector lamp assembly, as shown in FIG. 1, is the sum of contributions from all the incremental elements of the reflecting surface. All or nearly all the elements of the reflector contribute light at points within a central region 40. With respect to points successively outward from region 40 to an outer limit 42, fewer and fewer reflector elements contribute light.

Figure 4:
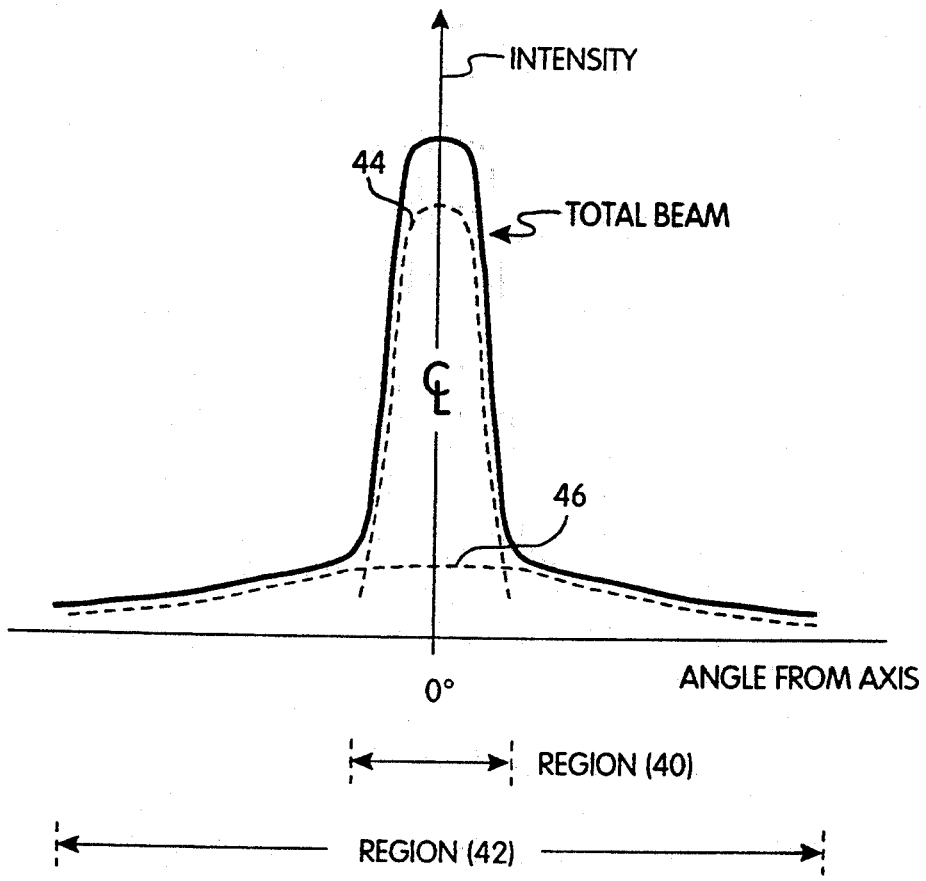
FIG. 4 is a graph of light intensity as a function of angle from the reflector axis showing a beam pattern in accordance with the prior art.
Figure 5:
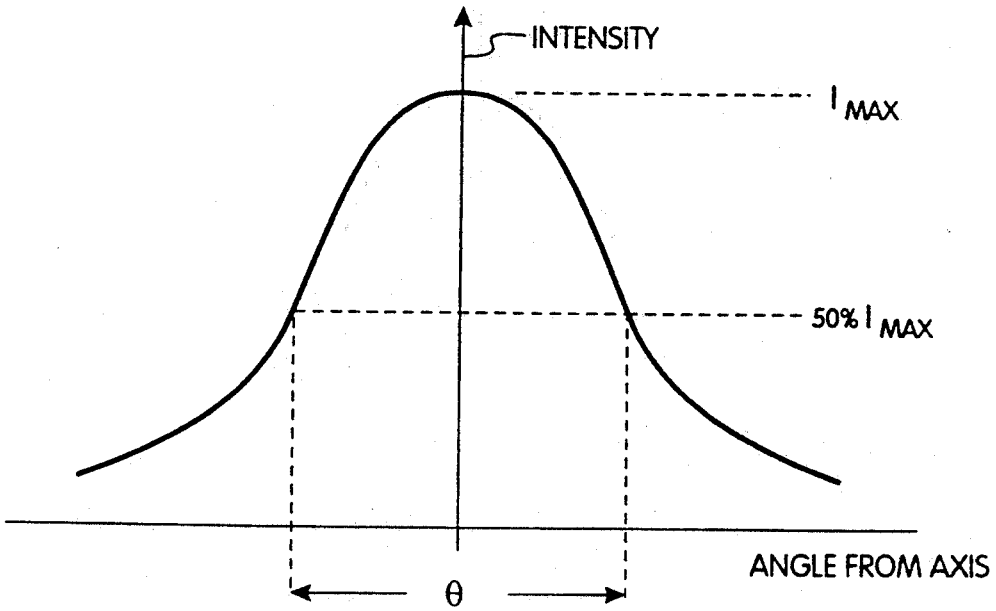
FIG. 5 is a graph of light intensity as a function of angle from the reflector axis showing a desired beam pattern.

The light pattern thus produced in a plane perpendicular to reflector axis 18 is shown graphically in FIG. 4. Light intensity is plotted as a function of angle from reflector axis 18. A high intensity portion 44 corresponding to region 40 near the beam center is superimposed on a low intensity portion 46 that spreads over a large angular range. It can be determined from geometrical optics that the dimension of region 40 depends on the filament diameter, while the dimension of region 42 depends on filament length. Relatively large changes in the shape of reflector 10 produce only minor changes in the central part of the beam shown in FIG. 4. Instead, the boundary of region 42 in the low intensity part of the beam changes. The outer part of the light pattern is well beyond the main, and commonly and most useful, part of the beam. The beam angle is typically defined as the angle which includes a region where the light intensity is greater than 50% of the maximum intensity. In general, a beam pattern of the type shown in FIG. 4 is undesirable because it has a central region of high intensity and a relatively large surrounding area of low but significant intensity. A more desirable beam pattern has a relatively uniform intensity within a desired beam angle and smoothly falls off to an insignificant intensity outside the beam angle. A preferred beam pattern is shown in FIG. 5.

In accordance with the present invention, a faceted reflecting surface is used to provide a desired light pattern with a long, small diameter filament. The pattern is generally of the form shown in FIG. 5 and can have a desired beam width in the range of about 7 to 65 degrees, even when long, small diameter filaments are utilized. The facets are used control the beam pattern from the reflector.

Figure 6A:
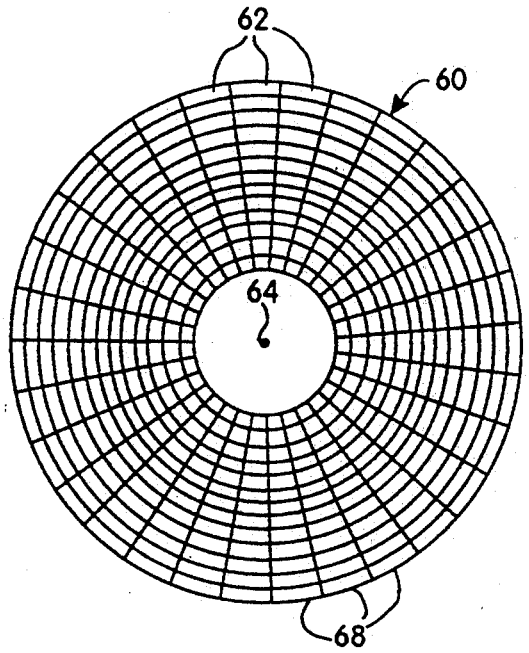
FIGS. 6A and 6B show axial and off axis views, respectively, of a faceted reflector in accordance with the present invention.
Figure 6B:
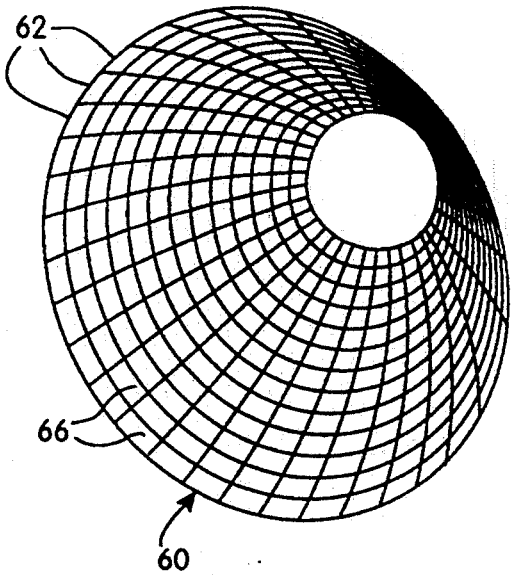

A preferred general form of the reflector is shown in FIGS. 6A and 6B. A reflecting surface 60 includes a multiplicity of reflecting facets 62. Each facet 62 has a reflecting surface of a defined size and curvature as discussed below. In this embodiment, the facets are arranged in rings 66 centered on a reflector axis 64 and lying in planes perpendicular to reflector axis 64. The facets 62 are arranged in columns 68, as best shown in FIG. 6A, so that the facets in a column are aligned in an axial direction. In the embodiment of FIGS. 6A and 6B, each of the rings 66 has the same number of facets. More generally in accordance with the present invention, the reflecting surface 60 includes one or more groups of facet rings. The facet rings within each group have the same number of facets. Thus, for example, a reflecting surface may include a group of 12 rings each having 50 facets and a group of 7 rings each having 25 facets.

The size and shape of a light beam reflected from a single facet 62 is a function of three parameters: 1) the beam spread that would occur in the limit as the area of the facet shrinks to zero (this is the spread discussed above in conjunction with FIG. 1), 2) the area of the facet and 3) the surface curvature of the facet. The area and the surface curvature are interactive. The spread in any plane containing the central normal to the facet is a function of the product of the linear dimension of the facet in that plane and the curvature of the intersection of the facet with the plane.

Referring again to FIG. 1, a smooth, nonfaceted reflector with a long, small diameter filament produces a light distribution as shown in FIGS. 3 and 4. The objective is to make a light pattern of the general form shown in FIG. 5 where the beam angle $\Theta$ shown in FIG. 5 is significantly greater than the beam angle shown in FIG. 4. To assist in understanding the light pattern produced by a facet, meridional and sagittal planes are defined. The meridional plane for a facet is that plane containing the reflector axis of revolution and passing through the center of the facet. The sagittal plane is that plane containing the central ray of the reflected solid angle pencil of rays and normal to the meridional plane. Spread added to the local beam in the meridian plane increases the elemental beam 34 shown in FIG. 2 in the Y—Y direction. Commonly, the spread in the Y—Y direction in the absence of a facet is larger than necessary to obtain a desired lamp performance. Sagittal plane spread increases the spread of elemental beam 34 in the X—X direction. When the multiple elements over the reflector surface spread in the X—X direction, the required beam spread of FIG. 5 is obtained.

If no spread is provided in the Y—Y direction, the coils of an axially located incandescent filament produce cosmetically objectionable ring type striations about the center of light beam. Therefore a very small spread is introduced by the facet 62 in the meridian plane (direction Y—Y of FIG. 2). The angular spread to be added in the meridional plane is approximately that of the angular separation of striations when the beam is viewed using a smooth reflector.

The spread produced by facets in different areas of the reflector is different because different facets have different orientations and spacings relative to the filament. In accordance with the present invention, the facets over at least 50% of the reflecting surface of reflector 60 have dimensions and curvature selected to produce filament image 34 (FIG. 2), wherein a ratio of filament width spread in the X—X direction to filament length spread in the Y—Y direction produced by the facets is at least 2:1 and is preferably 3:1 or greater. The reflector configuration of the invention is advantageously used with filaments having a length to diameter ratio of 6:1 or greater and is preferably utilized with filaments having a length to diameter ratio of 12:1 or greater. Typical filaments rated above 120 volts and below 150 watts have a length in a range of about 10 mm to 25 mm and a diameter in a range of about 0.2 mm to 2 mm.

The design of a reflector lamp assembly starts with the filament required to meet the desired voltage rating. The desired life rating of the lamp determines the filament temperature. The luminous flux to form the required intensity distribution determines the filament power, or wattage. From the voltage, temperature and power of the filament, the size of a practical, stable and manufacturable filament can be determined by standard, well known filament design techniques.

Next, the elemental beams from various parts of a smooth reflector of the desired size are determined either by experiment or by analysis using standard ray tracing techniques of geometric optics as they apply to reflective surfaces. For example, see "Mirror and Prism Systems", R. Hopkins, in *Applied Optics and Optical Engineering*, Vol. III, R. Kingslake Editor, Academic Press, 1965, pages 269 to 308, which is hereby incorporated by reference. Then, sagittal spread and spread in the meridional plane are added until the desired beam pattern is obtained. The general facet pattern is shown in FIGS. 6A and 6B.

Since the added spread in a given direction due to the facets is proportional to the product of facet width and curvature, a tradeoff of these two parameters can be made to obtain a practical reflector design. If the facets are too small, tooling is expensive. Also, uncontrolled scattering due to the facet intersections increases as the number of facet intersections increases. If the facets are too large not enough elemental patterns overlap to form the desired beam quality. Also, excessively wide facets may introduce more spread than is desired and more spread than can be compensated for by any practical curvature. If the curvature of the facets is too large (radius of curvature is too small), local glass thickness changes are undesirably large for molded glass reflectors. In metal reflectors, the metal would be subject to excessive local deformation during forming. Also, large local changes in a reflector surface increase the difficulty of virtually every manufacturing process, whether it be molding of glass or plastic, or drawing of metal.

Since the width and curvature of a facet cannot be determined by a closed form equation, these parameters are determined by ray traces using standard techniques of geometrical optics. Rays are traced from the perimeter of the projected area of the filament as seen from a facet location, as illustrated by solid angles 22 and 28 in FIG. 1. The reflected rays are first determined about the normal to the base reflector at the location of the facet. This represents the inherent spread due to the filament size and orientation and the location of the filament relative to the facet. This is the inherent spread for the point that cannot be reduced by local modification of the reflector. Next, the change in direction of the normal in the sagittal plane is determined for the required total beam spread in the sagittal plane (X—X direction spread in FIG. 2). Next, the change in direction of the normal in the meridional plane is determined for the required total meridional spread of the beam (Y—Y direction spread in FIG. 2). These changes in direction of local normals are achieved by a combination of offset and curvature of the facets from the initial normal position.

Figure 8:
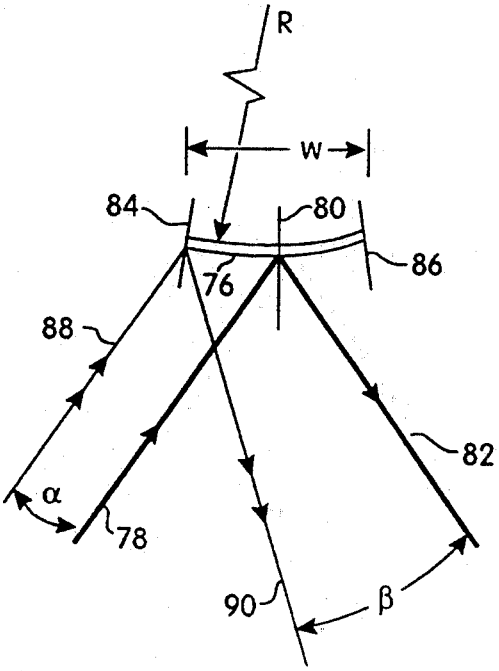
FIG. 8 is an enlarged cross sectional view of the reflecting surface in accordance with the invention, showing the details of reflection from a single facet.

The details of reflection from a single facet are shown in FIG. 8. A facet 76 has a width W and a radius of curvature R. The radius of curvature can be convex or concave with respect to the reflecting surface. In the example of FIG. 8, the curvature of facet 76 is convex. An incident perimeter ray 78 from the filament reflects about a normal 80 to the base reflector curve as a reflected ray 82. The facet is essentially centered about normal 80. The facet 76 has normals 84 and 86 at the edges defining width W. A ray 88 from the same initial perimeter point as ray 78 is at a small acute angle $\alpha$ from ray 78 and is incident on the facet edge at normal 84. A reflected ray 90 deviates from the original reflected ray 82 by an angle $\beta$. By examining the perimeter rays in relation to the desired spread, the required angular separation of the edge normals 84 and 86 can be determined. A given separation can be achieved by various combinations of width W and radius of curvature R.

Although the facets have been described as symmetrical about a normal to the base curve near their center as shown in FIG. 8, the facets can be asymmetric about that normal, particularly in sagittal plane. This configuration directs light more to one side of the meridian plane through the facet than to the other side. Also, the facets at various circumferential locations about the reflector are not required to be the same. Such variations can be used to produce asymmetric light patterns with a reflector of nominal revolution.

Figure 7:
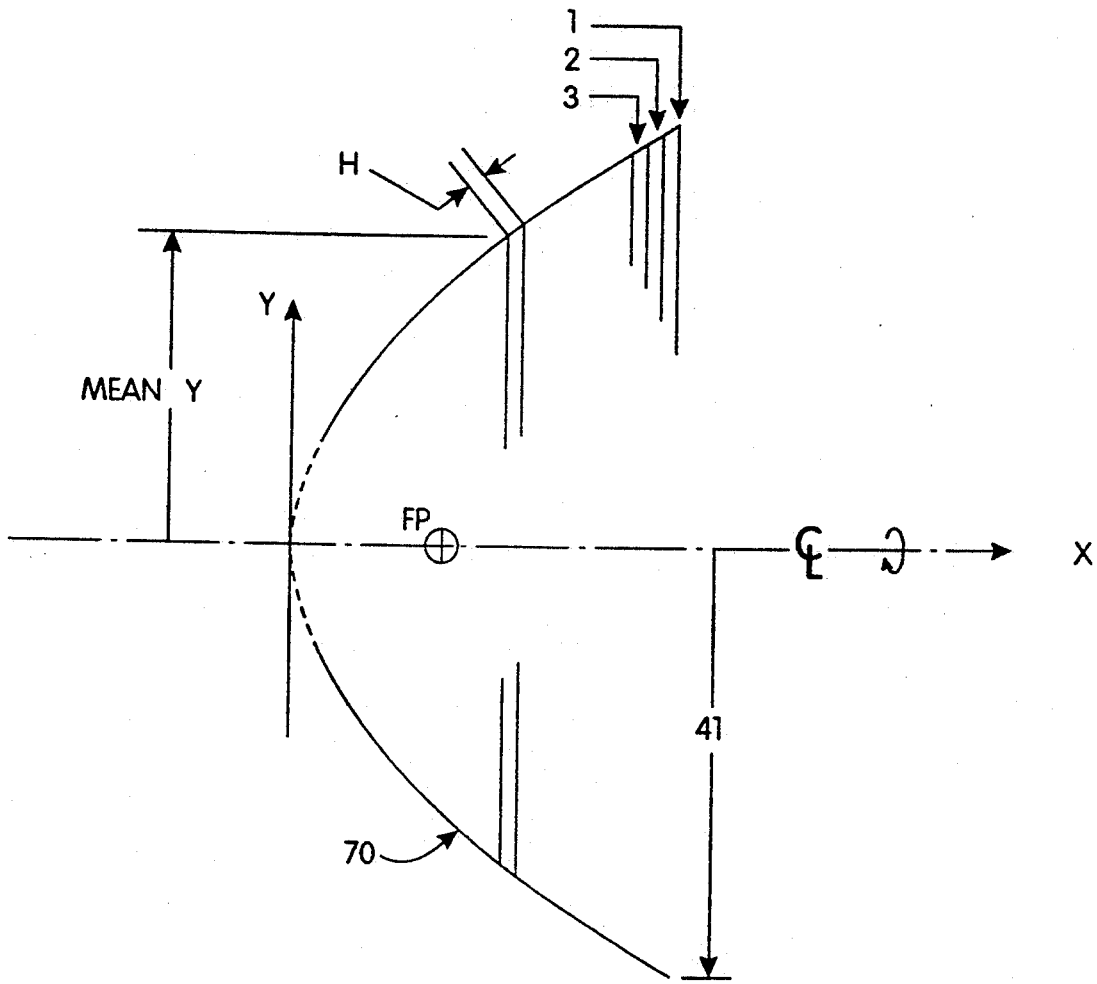
FIG. 7 is a schematic cross sectional view of a reflector showing facet parameters.

An example of the present invention will now be described with reference to FIGS. 7 and 9. A paraboloidal reflector 70 for a lamp of 95 mm overall diameter and having an aperture diameter of 82 millimeters and a focal length of 13 mm was constructed. The filament for the present example, designed to operate at 225 volts, had a length of 19.3 mm and a diameter of 0.71 mm. The filament was located on the X axis of the reflector shown in FIG. 7. The nominal reflecting surface of revolution was described by $Y^2=52X$, where the X and Y directions are shown in FIG. 7. The reflecting surface included facets arranged in 19 circumferential rings as specified in Table 1 below. The facet rings are numbered consecutively starting with the front surface of the reflector and proceeding toward the base of the reflector. Rings 1, 2 and 3 are shown by way of example in FIG. 7. For each of the 19 rings, Table 1 indicates the number of facets in the ring, the mean diameter Y of the ring, the width W of each facet in the ring, the radius of curvature R of each cylindrical facet in the ring and the height H of the ring. The axis of the cylinder is in a meridional plane through the center of the facet. The dimensions in Table 1 are in millimeters. The parameters mean diameter Y and H are shown in FIG. 7. The parameters W and R are shown in FIG. 8. Each ring of facets was displaced by 1° with respect to adjacent rings. Offset of facet rings is described below.

TABLE 1

| Ring Number | Number of Facets | Mean Y | W | R | H |
|---|---|---|---|---|---|
| 1 | 50 | 40.31 | 5.07 | 24.0 | 5 |
| 2 | 50 | 38.90 | 4.89 | 23.0 | 2.5 |
| 3 | 50 | 37.47 | 4.71 | 22.0 | 2.5 |
| 4 | 50 | 36.01 | 4.53 | 21.5 | 2.5 |
| 5 | 50 | 34.51 | 4.34 | 20.5 | 2.5 |
| 6 | 50 | 32.98 | 4.14 | 19.5 | 2.5 |
| 7 | 50 | 31.41 | 3.95 | 18.5 | 2.5 |
| 8 | 50 | 29.79 | 3.74 | 17.5 | 2.5 |
| 9 | 50 | 28.31 | 3.54 | 16.5 | 2.5 |
| 10 | 50 | 26.42 | 3.32 | 15.5 | 2.5 |
| 11 | 50 | 24.66 | 3.10 | 14.5 | 2.5 |
| 12 | 50 | 22.84 | 2.87 | 13.0 | 2.5 |
| 13 | 25 | 21.14 | 5.31 | 35.0 | 2.0 |
| 14 | 25 | 19.58 | 4.92 | 31.0 | 2.0 |
| 15 | 25 | 17.97 | 4.52 | 27.0 | 2.0 |
| 16 | 25 | 16.30 | 4.10 | 23.0 | 2.0 |
| 17 | 25 | 14.57 | 3.66 | 19.0 | 2.0 |
| 18 | 25 | 12.76 | 3.21 | 15.0 | 2.0 |
| 19 | 25 | 10.88 | 2.73 | 12.0 | 2.0 |

Figure 9:
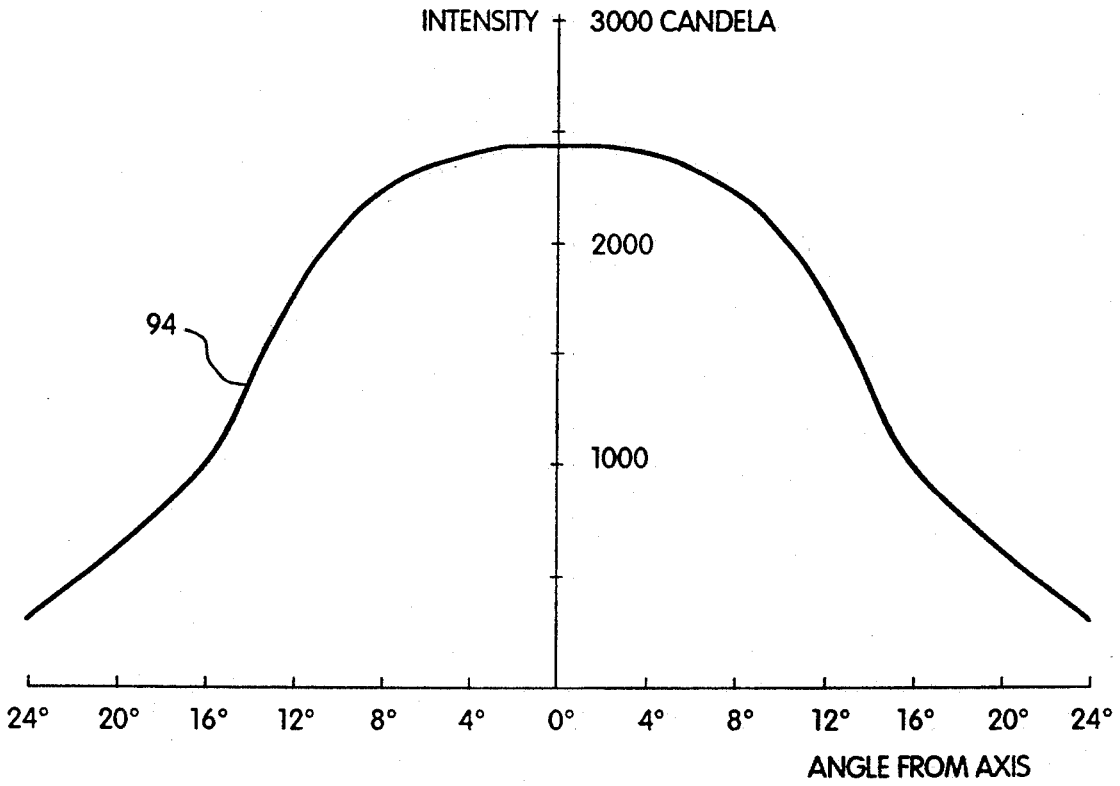
FIG. 9 is a graph of light intensity as a function of angle from the reflector axis for an example of the present invention.

The beam pattern produced by the above example of the present invention is shown in FIG. 9 as curve 94. The beam pattern has a central region of more or less uniform intensity and a beam width of about 30°. The intensity decreases rapidly outside the beam pattern.

The central part of the light beam produced by the reflector 60 shown in FIGS. 6A and 6B is composed of overlapping beams from many or all of the reflector facets. Due to the overlapping of many components of different spread and orientation, the central part of the beam is relatively uniform. Near the outer periphery of the beam pattern, however, only a few facets contribute light at any given point. The light pattern of each facet is long radially and narrow circumferentially. The angular separation of facet columns in the circumferential direction appears in the light pattern as circumferential variations in light intensity. If the angular separation of the few beams that overlap in the outer region is sufficient, radial streaks or striations are observed near the edge of the beam.

Decreasing the facet width circumferentially so as to increase the number of facet columns will decrease the angular separation of the elemental beams from the facets and will make the outer regions of the beam more uniform. However, facet width is one of the parameters that determines the overall beam angle of the reflector lamp and cannot be freely changed. Furthermore, an increase in the number of facets increases scattered light and increases the cost of tooling as discussed above.

In accordance with another aspect of the invention, the total beam from a column of facets is spread circumferentially without changing the spread from any individual facet by centering each facet in the column on a different meridian plane or at least distributing the facet centers among several meridian planes. This technique can be described in terms of circumferential facet rings. Each facet ring is advanced, or offset, by a small angle with respect to the adjacent ring.

Figure 10A:
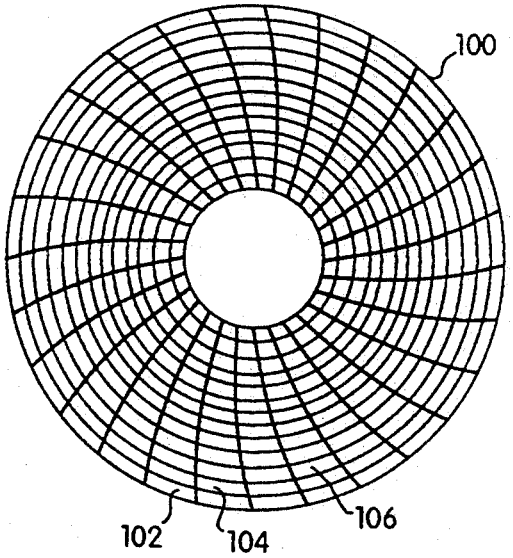
FIGS. 10A and 10B are axial and off axis views, respectively, of a reflector in accordance with the present invention having offset rings of facets.
Figure 10B:
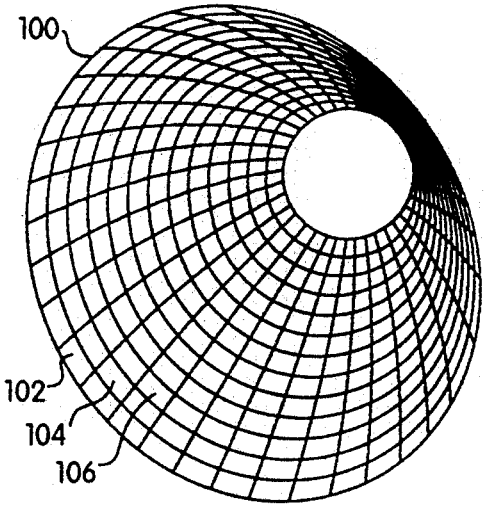

As shown in FIGS. 10A and 10B, a reflector 100 includes a facet ring 102 that is offset in a circumferential direction from an adjacent facet ring 104. Similarly, facet ring 104 is offset in a circumferential direction from an adjacent facet ring 106. In general, facet rings are successively offset in a circumferential direction. The reflector 100 is the same as the faceted reflectors described above, except that the facet rings are offset in a circumferential direction. A general description of the reflector appearance is that the facet columns spiral. The size of the angular offset for each ring depends on the striations that must be concealed and their sharpness. However, it is not necessary that each pair of adjacent rings have a full offset. Large angular offsets between adjacent rings can cause significant discontinuities between elements of the reflecting surface. Such discontinuities make production of the reflector more difficult and increase light scattering and loss. Preferably, small offsets are provided between adjacent rings such that the cumulative offset provides the necessary smoothing.

As an example, a reflector and filament having facets produced a 10° beam angle. The inherent spread of the reflector without facets was about 3.5°, and the spread added by the facets was about 6.5°. Little light was transferred to the outer part of the beam by this small spread, and radial striations were obvious at the beam edge when the facet rings were not offset. The reflector had 44 facet columns so that each of the 44 facets in a ring subtended an angle of about 8.18° about the reflector centerline. There were 24 facets in each column between the face and the vertex region of the reflector. One degree of angular offset was added successively to each facet ring such that the facet column spiraled a total of 24° about the reflector centerline. This offset configuration eliminated the radial striations that had a period of about 8.18°.

The period of striations near the outer boundaries of the beam pattern matches the facets in a ring. The minimum total angle of spiral for a column of facets to provide satisfactory smoothing generally falls between one half of the facet angle and the full facet angle. Preferably, the offset between adjacent facet rings is not greater than about 40% of the angle subtended by one of the facets. The offset between adjacent facet rings is typically about 30% or less of the angle subtended by one of the facets. Since the offset of facet rings within a column of facets contributes to smoothing in general for a variety of nonuniformities, the offset angle can be increased to a value greater than that required for controlling radial striations at the edge of the beam when it is advantageous to do so. Furthermore, successively offset facet rings can be utilized in any reflector lamp to reduce or eliminate circumferential nonuniformities in the light pattern.

The techniques describes herein are typically utilized with open faced lamps or lamps having a clear cover. However, the disclosed techniques can be utilized with a lens to further vary the light distribution. Although the reflector and lamp combination described herein is typically a PAR lamp, the invention can be applied to reflectors in luminaires using separate lamps.

Figure 11:
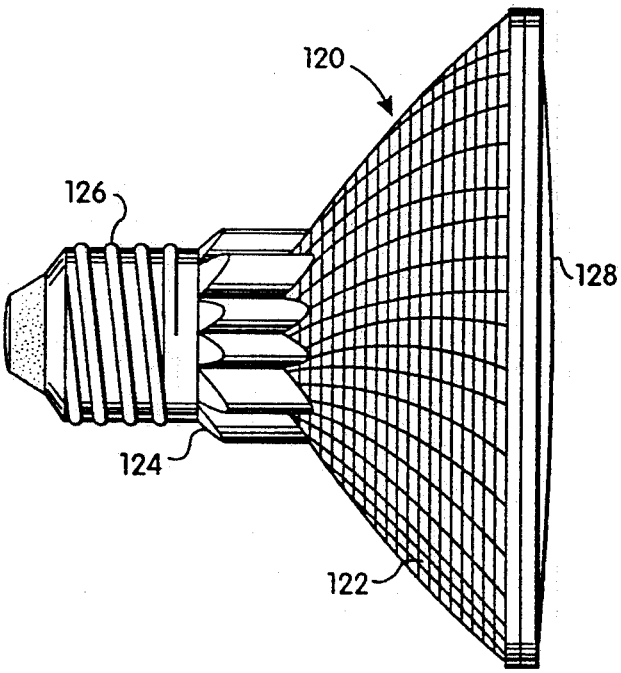
FIG. 11 is an elevational side view of an embodiment of a reflector lamp assembly in accordance with the present invention.
Figure 12:
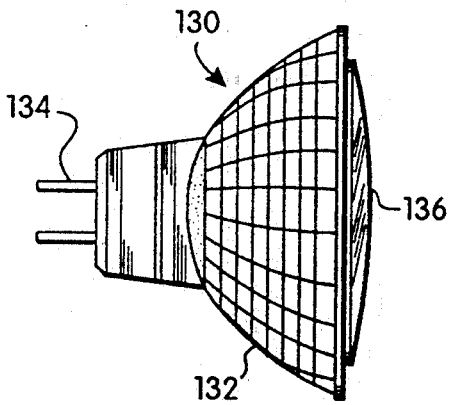
FIG. 12 is an elevational side view of a reflector lamp assembly in accordance with another embodiment of the invention.

Examples of lamps in accordance with the present invention are shown in FIGS. 11 and 12. A lamp 120 shown in FIG. 11 includes a reflector 122 having offset facet rings, a base 124 with an electrical connector 126, a cover 128 and a lamp (not shown). A lamp 130 shown in FIG. 12 includes a reflector 132 with offset facet rings, a base with a bipin connector 134, a cover 136 and a lamp (not shown).

While there have been shown and described what are at present considered the preferred embodiments of the present invention, it will be obvious to those skilled in the art that various changes and modifications may be made therein without departing from the scope of the invention as defined by the appended claims.

We claim:

1. A lamp assembly comprising:

a reflector having a concave reflecting surface and a axis of rotation; and a light source including a filament mounted approximately at a focal point of said reflecting surface and aligned with said axis of rotation, said filament having a length to diameter ratio of 6:1 or greater, said reflecting surface comprising a multiplicity of reflecting facets, the facets over at least 50% of the reflecting surface having dimensions and curvature selected to produce a light pattern wherein a ratio of filament width spread to filament length spread produced by the facets is at least 2:1.

2. A lamp assembly as defined in claim 1 wherein said axis of rotation defines an axial direction and a rotational direction around the axis and wherein said reflecting facets are arranged in axially adjacent rings that are centered on said axis and lie in a plane perpendicular to said axis.

3. A lamp assembly as defined in claim 2 wherein at least a plurality of said rings has the same number of facets.

4. A lamp assembly as defined in claim 3 wherein adjacent rings with the same number of facets are successively offset in the rotational direction.

5. A lamp assembly as defined in claim 4 wherein the total rotational offset of said plurality of rings is not less than one half of the angle subtended by one of said facets.

6. A lamp assembly as defined in claim 1 wherein the ratio of filament width spread to filament length spread produced by the facets is at least 3:1.

7. A lamp assembly as defined in claim 1 wherein said filament has a length to diameter ratio of 12:1 or greater.

8. A lamp assembly as defined in claim 1 wherein said filament is designed to operate at about 220 volts AC.

9. A lamp assembly as defined in claim 1 wherein said facets are rectangular in shape and are not substantially curved in the axial direction.

10. A lamp assembly as defined in claim 1 wherein said facets have a curvature and dimension in the rotational direction selected to provide a desired filament width spread.

11. A lamp assembly as defined in claim 4 wherein the offset between adjacent facet rings is not greater than 40% of the angle subtended by one of said facets.

12. A lamp assembly comprising:

a reflector having a concave reflecting surface and an axis of rotation that defines an axial direction and a rotational direction around the axis; and a light source including a filament mounted approximately at a focal point of said reflecting surface and aligned with said axis of rotation, said reflecting surface comprising a multiplicity of reflecting facets arranged in axially adjacent rings that are centered on said axis and lie in a plane perpendicular to said axis, at least a plurality of said rings having the same number of facets, adjacent rings with the same number of facets being successively offset in the rotational direction, wherein the total rotational offset of said plurality of rings is not less than one half the angle subtended by one of said facets.

13. A lamp assembly comprising:

a reflector having a concave reflecting surface and an axis of rotation that defines an axial direction and a rotational direction around the axis; and a light source including a filament mounted approximately at a focal point of said reflecting surface and aligned with said axis of rotation, said reflecting surface comprising a multiplicity of reflecting facets arranged in axially adjacent rings that are centered on said axis and lie in a plane perpendicular to said axis, at least a plurality of said rings having the same number of facets, adjacent rings with the same number of facets being successively offset in the rotational direction, wherein the offset between adjacent facet rings is not greater than 40% of the angle subtended by one of said facets.

* * * * *